US006916282B2

(12) United States Patent
Aizawa

(10) Patent No.: US 6,916,282 B2
(45) Date of Patent: Jul. 12, 2005

(54) SWING ROTOR FOR A CENTRIFUGAL SEPARATOR INCLUDING A SWINGABLY SUPPORTED BUCKET HAVING A SAMPLE CONTAINER HOLDING MEMBER AND METALLIC MEMBER

(75) Inventor: Masaharu Aizawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/196,947

(22) Filed: Jul. 18, 2002

(65) Prior Publication Data

US 2003/0017930 A1 Jan. 23, 2003

(30) Foreign Application Priority Data

Jul. 19, 2001 (JP) ..... 2001-219832

(51) Int. Cl.[7] ..... B04B 5/02
(52) U.S. Cl. ..... 494/20; 494/81
(58) Field of Search ..... 494/16, 20, 21, 494/31, 33, 43, 85, 81; 422/72, 102

(56) References Cited

U.S. PATENT DOCUMENTS 4,009,824 A * 3/1977 Wright ..... 494/20
4,435,168 A * 3/1984 Kennedy ..... 494/20
4,531,652 A * 7/1985 Hara ..... 220/669
4,585,434 A * 4/1986 Cole ..... 494/20
5,411,465 A * 5/1995 Glen et al. ..... 494/16
5,490,830 A * 2/1996 Lovelady et al. ..... 494/14
5,667,755 A * 9/1997 Baum et al. ..... 422/101
6,350,225 B1 * 2/2002 Sheeran et al. ..... 494/12

FOREIGN PATENT DOCUMENTS

| | | |
|---|---|---|
| JP | 49-15066 | 2/1974 |
| JP | 63-2110 | 1/1988 |
| JP | 63-35797 | 9/1988 |
| JP | 6-285390 | 10/1994 |
| JP | 7-222940 | * 8/1995 |
| JP | 11-276929 | * 10/1999 |
| JP | 2003-24823 | * 1/2003 |

* cited by examiner

*Primary Examiner*—Charles E. Cooley
(74) *Attorney, Agent, or Firm*—McDermott Will & Emery LLP

(57) ABSTRACT

A bucket consists of a sample container holding member and a metallic member. The sample container holding member is made of a composite material consisting of a reinforcing fiber and a resin. The metallic member has portions engaged with a rotor body.

5 Claims, 4 Drawing Sheets

SWING ROTOR FOR A CENTRIFUGAL SEPARATOR INCLUDING A SWINGABLY SUPPORTED BUCKET HAVING A SAMPLE CONTAINER HOLDING MEMBER AND METALLIC MEMBER

BACKGROUND OF THE INVENTION

The present invention relates to a swing rotor of a centrifugal separator which is widely used in medical, pharmaceutical, and genetic engineering and in other various fields.

More specifically, the present invention relates to improvement of strength and performance of the swing rotor of a centrifugal separator.

Furthermore, the present invention relates to energy saving, structural simplification, and cost reduction for centrifugal separators.

The swing rotors generally used in the field of clinical medicine for separating blood specimens sampled for the purpose of various inspections need to cover the maximum rotational speeds ranging from 2,000 $min^{-1}$ to 20,000 $min^{-1}$. This kind of conventional swing rotors are disclosed, for example, in the unexamined Japanese patent publication No. 49-15066, Japanese utility model No. 63-2110, Japanese utility model No. 63-35797, and the unexamined Japanese patent publication No. 6-285390.

FIGS. 7 to 9 show an example of this type of conventional swing rotors.

In FIGS. 7 to 9, a rotor body 1 has a central hole 1*a*. A drive shaft (not shown) of a motor (not shown) is coupled into the central hole 1*a* to rotate the rotor body 1. The rotor body 1 chiefly consists of symmetrically branched arms 2 extending in radial directions at equal angular intervals (90°) for holding a total of four buckets 4 between respective arms 2. Hinge pins 3 are attached to distal ends of respective arms 2. Each bucket 4 is supported by two hinge pins 3 which extend coaxially from opposed arms 2. Each bucket 4 is thus swingable about an axis defined by these coaxial hinge pins 3. The bucket 4 accommodates a centrifugal tube rack 6. A plurality of centrifugal tubes 5, each storing a sample solution to be tested or inspected, are positioned in a predetermined pattern in this rack 6.

The rotor body 1 is made of a stainless steel or an aluminum alloy and is manufactured by the forging, casting, machining or the like. Each pin 3 is integrally formed with the rotor body 1 from the same material. Alternatively, each pin 3 is a separate part independent of the rotor body 1. For example, the pin 3 can be manufactured by the machining from a stainless steel or a comparable steel. Then, the pin 3 is installed or inserted into an engaging hole formed at a predetermined portion of the arm 2. The bucket 4 is made of an aluminum alloy and manufactured by the machining or casting. Alternatively, the bucket 4 can be manufactured by the press working from a stainless steel sheet.

The assurance term or guaranteed lifetime as well as the allowable rotational speeds of each swing rotor are determined by a manufacturer of this rotor. Users can use this rotor safely as far as they obey the restrictions and conditions determined by the manufacturer. If the swing rotor is forcibly used at higher speeds exceeding the allowable upper limit, or if the swing rotor is continuously used for a long time exceeding the guaranteed lifetime, the swing rotor will break and a centrifugal separator will be damaged. The energy caused when the swing rotor breaks is so large that the centrifugal separator shifts or moves suddenly and closely toward an operator of this machine and endangers the operator.

From the above, all of the parts constituting a swing rotor need to guarantee the performance of this swing rotor and also need to assure satisfactory mechanical strength for the guaranteed operation speeds and lifetime.

On the other hand, recent centrifugal separators are required to perform advanced centrifugal separations at higher speeds and under large centrifugal forces and also required to process a large number of samples to be tested or inspected at a time.

The buckets used for the conventional swing rotors, when manufactured by the machining from a metallic material, generally require a large amount of labor time and man power in the process of cutting or machining the metallic material into the shape of a bucket. This increases the manufacturing cost. Furthermore, the metallic bucket has a large specific gravity and a large thickness due to inherent nature of metallic material. When a centrifugal force is applied on the bucket, a rotor body receives a large centrifugal load. This will possibly deteriorate the performance of a centrifugal separator.

On the other hand, the buckets for the conventional swing rotors, when manufactured by the press working from a stainless steel, generally require expensive pressing dies as well as specialized pressing machine facilities. This increases the manufacturing cost. Furthermore, when a stainless steel is subjected to the press working, there is the possibility that a manufactured bucket has uneven portions having different thicknesses. For example, to assemble the stainless-made bucket with a swing rotor, very complicated or difficult processing is required to form appropriate coupling or engaging portions on this bucket. This processing will possibly leave weak portions having insufficient thicknesses on the processed bucket. As a result, the manufactured bucket will have a poor strength and may break during a severe centrifugal operation.

Furthermore, when equipped with metallic buckets, a swing rotor is subjected to a large inertia moment due to a large specific gravity of the metallic buckets. This requires a drive motor to generate a large driving power. Furthermore, a long time will be necessary for the drive motor to accelerate and decelerate the rotor. The rotational energy of a swing rotor increases in proportion to increased moment of inertia. Considering this rotational energy, a centrifugal separator needs to be equipped with a protective barrier (i.e., a safety wall or partition) having a sufficient strength capable of protecting an operator against breakage of a swing rotor.

SUMMARY OF THE INVENTION

An object of the present invention is to provide a high performance swing rotor which is excellent in strength, small in moment of inertia, and reliable in safety.

Another object of the present invention is to provide a bucket used for centrifugal separation.

In order to accomplish this and other related objects, the present invention provides a first swing rotor for a centrifugal separator comprising a rotor body having a central hole into which a drive shaft of a drive motor is coupled, and at least one bucket swingably supported by the rotor body. The bucket of the first swing rotor comprises a sample container holding member and a metallic member. The sample container holding member is made of a composite material consisting of a reinforcing fiber and a resin. And, the metallic member has portions engaged with the rotor body.

It is preferable for the first swing rotor that the metallic member is a metallic ring. The metallic ring has an inner wall fitting to an outer surface of the sample container holding member. And, the metallic ring has an arrangement for receiving a centrifugal force acting on the sample container holding member.

It is preferable for the first swing rotor that the sample container holding member has an opened top and a closed bottom with a vertical wall extending upright from a peripheral edge of the bottom. A flange is provided at an upper portion of the sample container holding member. The flange is engaged with the metallic ring so that the metallic ring can receive the centrifugal force acting on the sample container holding member. And, the flange is made of the composite material consisting of the reinforcing fiber and the resin and is integrally manufactured with the sample container holding member.

It is preferable for the first swing rotor that the sample container holding member has a rib extending along the flange so as to enhance the rigidity of the flange.

It is preferable for the first swing rotor that the metallic ring is integrated with the sample container holding member by bonding or press fitting.

It is preferable for the first swing rotor that a polyaramide fiber is provided in a surficial layer of the sample container holding member.

Furthermore, the present invention provides a second swing rotor for a centrifugal separator comprising a rotor body having symmetrically branched arms extending in radial directions at equal angular intervals, and a plurality of buckets swingably supported between respective arms of the rotor body. According to the second swing rotor of this invention, each of the plurality of buckets comprises a sample container holding member and a metallic member integrally coupled with each other. The sample container holding member is made of a composite material consisting of a reinforcing fiber and a resin. The metallic member has a surface fitting to a surface of the sample container holding member and has portions engaged with the rotor body. And, a supporting mechanism is provided for receiving a centrifugal force acting on the sample container holding member by the metallic member.

It is preferable for the second swing rotor that the sample container holding member has an opened top and a closed bottom with a vertical wall extending upright from a peripheral edge of the bottom.

It is preferable for the second swing rotor that the supporting mechanism is a flange formed along the opened top of the sample container holding member.

It is preferable for the second swing rotor that a rib extends along the flange so as to enhance the rigidity of the flange.

It is preferable for the second swing rotor that the metallic member surrounds an upper part of the sample container holding member.

It is preferable for the second swing rotor that the sample container holding member has a surface perpendicular to an axis of the sample container holding member. The axis of the sample container holding member is identical with a direction of a centrifugal force acting on the sample container holding member. And, the metallic member has a surface brought into contact with the surface of the sample container holding member so as to constitute the supporting mechanism.

Moreover, the present invention provides a bucket for a swing rotor used in a centrifugal separator, comprising a sample container holding member made of a composite material consisting of a reinforcing fiber and a resin. A metallic member is coupled with the sample container holding member. And, an engaging mechanism is provided for engaging the sample container holding member with the metallic member. A centrifugal force acting on the sample container holding member is received by the metallic member via the engaging mechanism.

It is preferable that the metallic member of this bucket is a metallic ring. The metallic ring has an inner wall fitting to an outer surface of the sample container holding member. And, the metallic ring has a surface serving as part of the engaging mechanism for receiving the centrifugal force acting on the sample container holding member.

It is preferable that the sample container holding member of this bucket has an opened top and a closed bottom with a vertical wall extending upright from a peripheral edge of the bottom. A flange is provided at an upper portion of the sample container holding member. The flange is engaged with the surface of the metallic ring so as to cooperatively constitute the engaging mechanism for receiving the centrifugal force acting on the sample container holding member.

It is preferable that the flange of this bucket is made of the composite material consisting of the reinforcing fiber and the resin and is integrally manufactured with the sample container holding member.

It is preferable that the sample container holding member of this bucket has a rib extending along the flange so as to enhance the rigidity of the flange.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENTS

Figure 1:
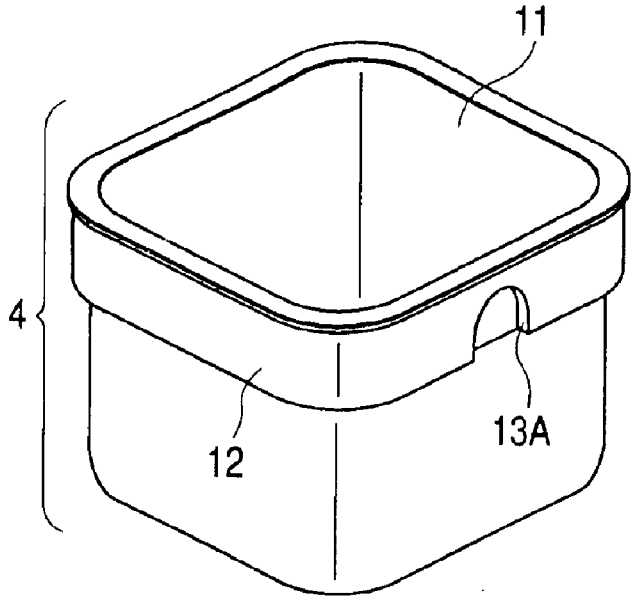
FIG. 1 is a perspective view showing the appearance of a bucket in accordance with a preferred embodiment of the present invention.

A swing rotor of a centrifugal separator in accordance with a preferred embodiment will be explained with reference to FIGS. 1 to 6. Identical parts are denoted by the same reference numerals.

In FIG. 1, a bucket 4 comprises a sample container holding member 11 configured into a predetermined basket shape and a metallic ring 12 coupled or assembled with the sample container holding member 11. The sample container holding member 11 has an opened top and a closed bottom, with a vertical wall extending upright from a peripheral edge of the bottom. The sample container holding member 11 has a rectangular or square cross section taken along in a lateral or horizontal plane perpendicular to a vertical axis of this sample container holding member 11. Although not shown in the drawing, the cross section of sample container holding member 11 is not limited to a rectangular or square one. It is therefore preferable that the sample container holding member 11 has a circular or any other cross section. The configuration of sample container holding member 11 should be determined considering the shape of a sample container which is to be accommodated in this sample container holding member 11.

The metallic ring 12 surrounds an upper part of the sample container holding member 11. The metallic ring 12 is tightly brought into contact with the sample container holding member 11. The metallic ring 12 is integrated with the sample container holding member 11 by bonding or press fitting. The vertical size (i.e., height) of metallic ring 12 is smaller than that of sample container holding member 11. For example, the heigh of metallic ring 12 is one third or less with respect to the height of sample container holding member 11. However, the ratio of the heigh of metallic ring 12 to the height of sample container holding member 11 should be determined considering the required mechanical strengths of metallic ring 12 and sample container holding member 11.

The metallic ring 12 has an inner wall just fitting to an outer surface of sample container holding member 11. The metallic ring 12 has an outer wall on which engaging portions 13A are formed. Each engaging portion 13A is a recess having a round edge which is slidably coupled with the pin 3 of rotor body 1. The bucket 4 is supported via engaging portions 13A of metallic ring 12 by the pins 3 so as to be swingable with respect to the rotor body 1. The sample container holding member 11 has a flange 11A at its upper end. The flange 11A extends entirely along the upper peripheral edge (i.e., the opened top) of the sample container holding member 11.

The flange 11A of sample container holding member 11 extends radially outward and is perpendicular to the vertical wall of the sample container holding member 11. A lower surface of flange 11A is brought into contact with an upper end surface of metallic ring 12. The metallic ring 12 receives a centrifugal force acting on the sample container holding member 11 via the flange 11A when the rotor body 1 rotates.

In this respect, the sample container holding member 11 has a surface perpendicular to an axis of the sample container holding member 11. The axis of sample container holding member 11 is identical with a direction of the centrifugal force acting on the sample container holding member 11. The metallic ring 12 has a surface brought into contact with the surface of sample container holding member 11 so as to constitute a supporting mechanism for receiving a centrifugal force acting on the sample container holding member 11 by the metallic ring 12.

The altitudinal position of flange 11A with respect to sample container holding member 11 is not limited to the uppermost end of sample container holding member 11. For example, it is preferable to provide the flange 11A at a portion offset a predetermined distance from the uppermost end of sample container holding member 11. If the flange 11A has a sufficient rigidity or strength, it is possible to remove the flange 11A partly or to reduce the width or thickness of flange 11A.

Figure 7:
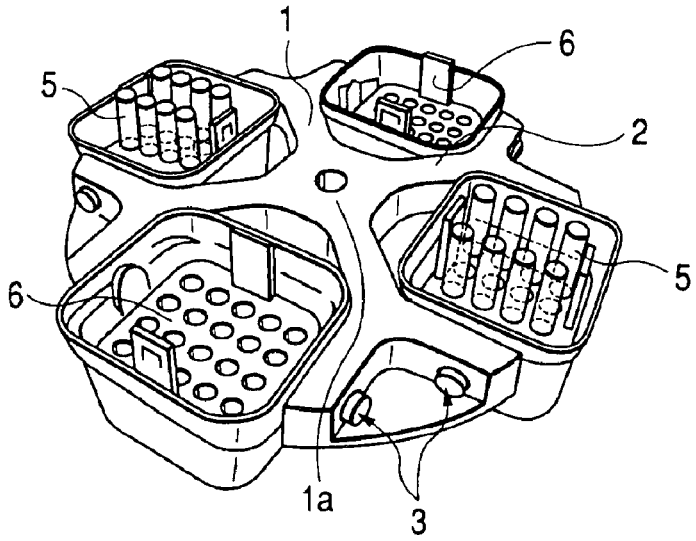
FIG. 7 PRIOR ART
FIG. 7 is a perspective view showing the appearance of a swing rotor equipped with conventional buckets.
Figure 8:
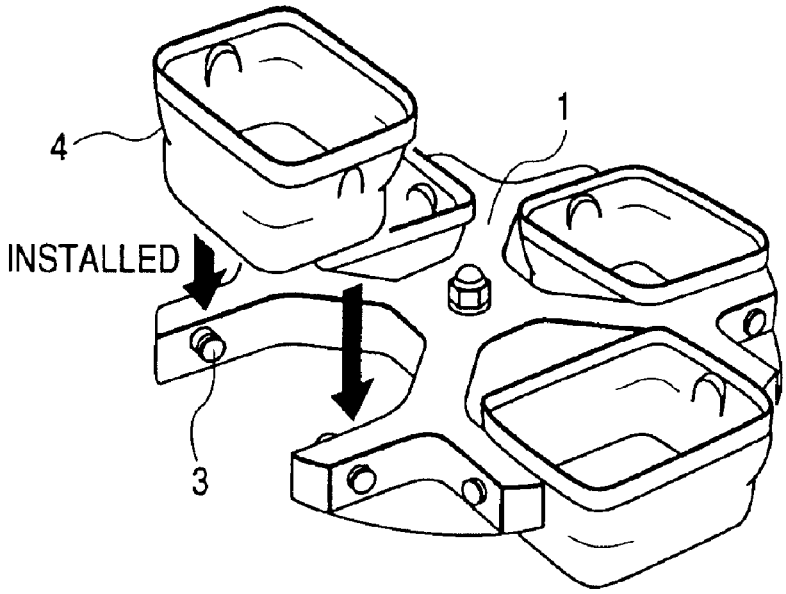
FIG. 8 PRIOR ART
FIG. 8 is a perspective view explaining installation of a conventional bucket to the swing rotor.
Figure 9:
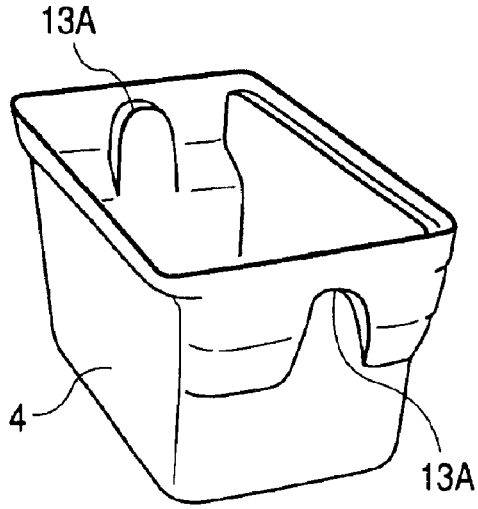
FIG. 9 PRIOR ART
FIG. 9 is a perspective view showing the appearance of a conventional bucket.

The bucket 4 is swingably supported by the rotor body 1 disclosed in FIGS. 7 to 9. The rotor body 1 has the central hole 1*a* into which the drive shaft (not shown) of the motor (not shown) is coupled. The rotor body 1 rotates about its axis (i.e., central hole 1*a*). The rotor body 1 has symmetrically branched arms 2 extending in radial directions at equal angular intervals for holding a plurality of buckets 4 between respective arms 2. Hinge pins 3 are attached to distal ends of respective arms 2. Each bucket 4 is supported by two hinge pins 3 which extend coaxially from opposed arms 2. Each bucket 4 is thus swingable about an axis defined by these coaxial hinge pins 3.

The rotor body 1 is made of a stainless steel or an aluminum alloy and is manufactured by the forging, casting, machining or the like. Each pin 3 is integrally formed with the rotor body 1 from the same material, or separately formed independent of the rotor body 1. For example, the pin 3 can be manufactured by the machining from a stainless steel or a comparable steel. Then, the pin 3 is installed or inserted into an engaging hole formed at a predetermined portion of the arm 2.

Figure 2:
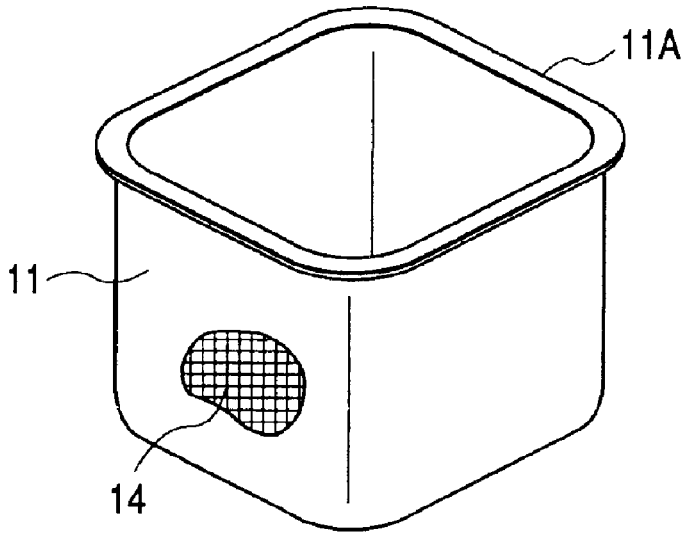
FIG. 2 is a perspective view showing the appearance of a sample container holding member constituting part of the bucket in accordance with the preferred embodiment of the present invention.

FIG. 2 shows the appearance of sample container holding member 11. The sample container holding member 11 has a bottom to accommodate centrifugal tubes 5 and centrifugal rack 6. The centrifugal rack 6 has a plurality of holes or recesses for stationarily holding centrifugal tubes 5. The centrifugal rack 6 has a laterally extending platelike shape just fitting to the inside wall of sample container holding member 11.

The sample container holding member 11 is made of a composite material and is integrally molded into the predetermined basket shape. The composite material consists of a reinforcing fiber 14 and a resin matrix. For example, the sample container holding member 11 is manufactured in the following manner.

First, a plurality of fabric prepreg sheets or comparable reinforcing fiber sheets are laminated in a direction perpendicular to the surface thereof. Then, the laminated fabric prepreg sheets are put into the dies cooperatively defining a shape of sample container holding member 11. Then, in the condition that the laminated fabric prepreg sheets are placed in the dies, a heat treatment is applied to the laminated prepreg sheets to melt the resin. And then, a press working is applied on the heated laminated prepreg sheets to harden the molten resin of the laminated prepreg sheets, thereby molding the laminated prepreg sheets into the shape of sample container holding member 11.

The materials preferably usable for the reinforcing fiber 14 are, for example, carbon fiber, glass fiber, and organic high-elastic fiber (e.g., polyaramide fiber). These fibers are extended in parallel to each other and a resin is impregnated into these fibers to obtain a one-directional prepreg. Or, a resin is impregnated into a fabric of the above-described reinforcing fibers to obtain a fabric prepreg. It is also possible to use a stringlike reinforcing fiber which is used in a so-called filament winding method according to which a resin-impregnated stringlike fiber is directly wound around a male die of the sample container holding member 11.

The resin matrix is usually an epoxy resin, a unsaturated polyester resin, or a phenol resin which are collectively heat-hardening or thermoset resins. Alternatively, the resin matrix can be made of a nylon resin, a polyacetal resin, or a polycarbonate resin which are collectively thermoplastic resins.

Figure 3:
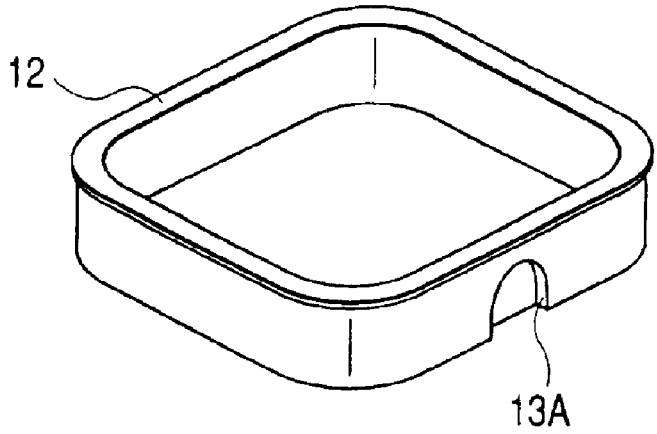
FIG. 3 is a perspective view showing the appearance of a metallic ring constituting part of the bucket in accordance with the preferred embodiment of the present invention.

FIG. 3 shows the metallic ring 12. The metallic ring 12 has an inner wall just fitting to an outer surface of the sample container holding member 11. The sample container holding member 11 is positioned inside the metallic ring 12. The metallic ring 12 has a pair of rotor coupling portions 13A formed at opposite side surfaces thereof. The rotor coupling portions 13A of metallic ring 12 are coupled with the pins 3 of rotor body 1. The top surface of metallic ring 12 is flat. The lower surface of the flange 11A is received by the flat top surface of metallic ring 12.

The materials preferably usable for the metallic ring 12 are an aluminum alloy and a stainless steel which are capable of assuring a sufficient strength for the rotor coupling portions 13A because the rotor coupling portions 13A swing about the coupled pins 3 under a large load acting between them.

To suppress the manufacturing cost for the metallic ring 12, it is preferable to use the ordinary machining or if required to use the lost wax casting method, the die casting method, or other precision casting.

Figure 4:
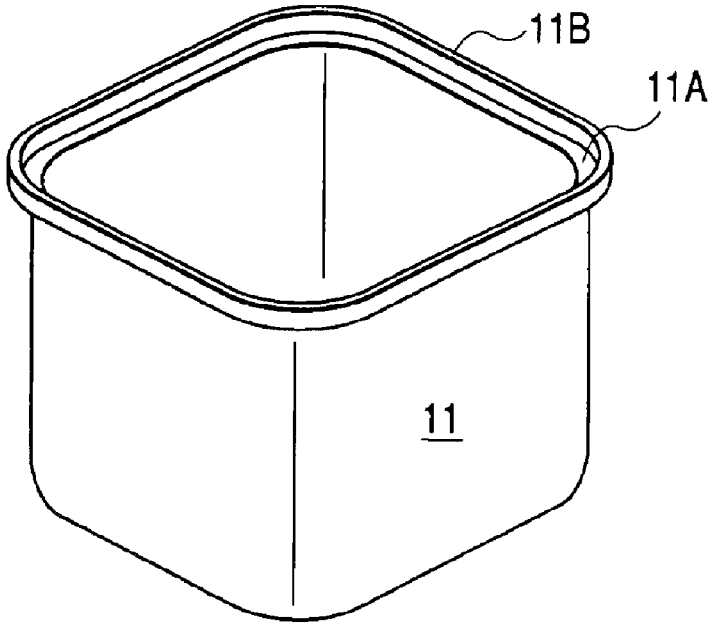
FIG. 4 is a perspective view showing the appearance of a modified sample container holding member constituting part of the bucket in accordance with the preferred embodiment of the present invention.
Figure 5:
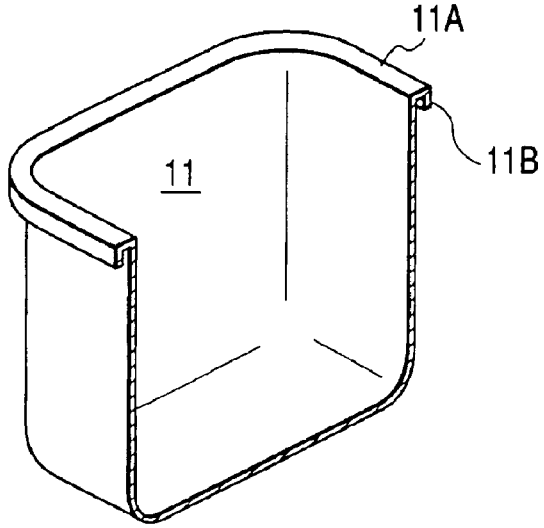
FIG. 5 is a perspective view showing the appearance of another modified sample container holding member constituting part of the bucket in accordance with the preferred embodiment of the present invention.

FIGS. 4 and 5 show modified embodiments of the sample container holding member 11, according to which the sample container holding member 11 has a rib 11B extending entirely along the outermost end of flange 11A formed at the opened top of the sample container holding member 11. The rib 11B extends upward (FIG. 4) or downward (FIG. 5) and is perpendicular to the flange 11A. The rib 11B enhances the rigidity of flange 11A so as to prevent the flange 11A from deforming due to large centrifugal forces acting on the centrifugal tubes 5, the centrifugal rack 6, and the sample container holding member 11 itself. As a result, the strength of flange 11A can be improved. Providing the rib 11B integrally with the flange 11A is effective to assure a required rigidity or strength for the flange 11A when weight reduction of sample container holding member 11 is required.

Figure 6:
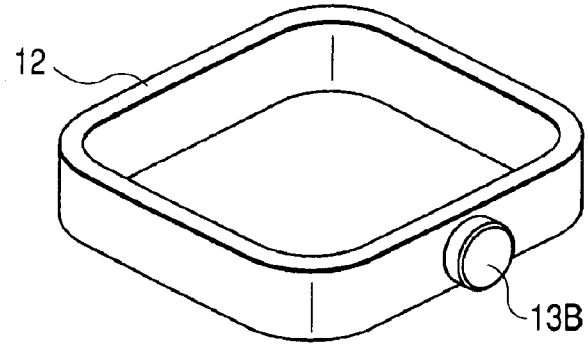
FIG. 6 is a perspective view showing the appearance of a modified metallic ring constituting part of the bucket in accordance with the preferred embodiment of the present invention.

FIG. 6 shows another modified embodiment of the sample container holding member 11, according to which the rotor body 1 has engaging recesses (not shown) formed at opposed arms 2. The pins 3 are removed in this case. Instead, protrusions 13B are provided at opposite side surfaces of the metallic ring 12. The protrusions 13B are engaged with the engaging recesses of opposed arms 2 so that the bucket 4 is swingably supported with respect to the rotor body 1.

As described above, the bucket 4 is a combination of a nonmetallic composite member (i.e., sample container holding member 11) and a metallic member (i.e., metallic ring 12). The sample container holding member 11 is made of a composite material which consists of the reinforcing fiber 14 and the resin matrix. Using such a composite material is effective to greatly reduce the weight of sample container holding member 11.

For example, a composite material consisting of carbon fibers and a resin has a lower density substantially equal to 1.6 even if it contains a great amount of fibers to assure excellent strength. The density (1.6) of this composite material is approximately 60% of the density of an aluminum alloy, or approximately 20% of the density of a stainless steel. Meanwhile, the strength of this composite material is substantially comparable with that of the aluminum alloy or the stainless steel. In other words, the weight reduction realized by the adoption of this composite material brings improved performance of a centrifugal separator by an extent equivalent to the attained weight reduction.

Furthermore, the weight reduction realized by the adoption of this composite material fairly reduces a load applied on the drive motor. This leads to energy saving. The time required for the drive motor to accelerate or decelerate can be shortened. The required rotational energy is small. The safety mechanism for a centrifugal separator, such as a protective barrier (i.e., a safety wall or partition), can be simplified. The manufacturing cost for a centrifugal separator can be reduced.

Furthermore, when the reinforcing fiber is a carbon fiber, there is the possibility that the carbon fiber may break due to frictional contact with a desk surface when the bucket is handled on a desk. This will deteriorate the strength of a bucket. To solve this problem, it is preferable to dispose a polyaramide fiber or a comparable organic high-elastic fiber in the surficial layer of the sample container holding member 11 of the bucket 4 since this kinds of fibers have excellent durability against a shear stress.

The bucket 4 is not limited to the disclosed combination of sample container holding member 11 and metallic ring 12. For example, the bucket 4 can be constituted by three or more pieces. When a centrifugal force acting on the bucket 4 is relatively low (due to low performance of swing rotor), it is possible to reduce the size of the metallic ring 12. For example, the metallic ring 12 can be replaced by smaller parts, such as metallic bearings serving as the rotor coupling portions to be coupled with the coupled pins of the swing body 1.

As apparent from the foregoing description, the bucket of this invention is constituted by a nonmetallic member serving as a portion for accommodating the samples and a metallic member serving as a portion to be engaged with a rotor body. The nonmetallic member is manufactured from a composite material consisting of a fiber and a resin. Accordingly, the present invention can greatly reduce the overall weight of a bucket used for centrifugal separation. Thus, the present invention makes it possible to improve the performance and strength of a swing rotor. It becomes possible to provide a swing rotor which has a small inertia moment. It becomes possible to downsize the drive motor. This leads to energy saving. Furthermore, the acceleration or deceleration time of a rotor can be shortened. This improves the efficiency of a centrifugal separation. Furthermore, in accordance with reduction of a rotational energy, the required safety mechanism for a centrifugal separator, such as a protective barrier (i.e., a safety wall or partition), can be simplified. The manufacturing cost for a centrifugal separator can be reduced.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A swing rotor for a centrifugal separator, comprising:

a rotor body having a central hole into which a drive shaft of a drive motor is coupled, and at least one bucket swingably supported by said rotor body, wherein said at least one bucket comprises a sample container holding member and a metallic member, said sample container holding member is made of a composite material consisting of a reinforcing fiber and a resin, and said metallic member has portions engaged with said rotor body wherein, said metallic member is a metallic ring, said metallic ring has an inner wall fitting to an outer surface of said sample container holding member, said metallic ring has an arrangement for receiving a centrifugal force acting on said sample container holding member, said sample container holding member has an opened top and a closed bottom with a wall extending upright from a peripheral edge of the bottom, a flange is provided at an upper portion of said sample container holding member, said flange being engaged with said metallic ring so that said metallic ring can receive the centrifugal force acting on said sample container holding member, and said flange is made of said composite material consisting of the reinforcing fiber and the resin and is integrally manufactured with said sample container holding member, and said sample container holding member has a rib extending along said flange so as to enhance the rigidity of said flange.

2. A swing rotor for a centrifugal separator, comprising:

a rotor body having a central hole into which a drive shaft of a drive motor is coupled, and at least one bucket swingably supported by said rotor body, wherein said at least one bucket comprises a sample container holding member and a metallic member, said sample container holding member is made of a composite material consisting of a reinforcing fiber and a resin, and said metallic member has portions engaged with said rotor body wherein, said metallic member is a metallic ring, said metallic ring has an inner wall fitting to an outer surface of said sample container holding member, said metallic ring has an arrangement for receiving a centrifugal force acting on said sample container holding member, said sample container holding member has an opened top and a closed bottom with a wall extending upright from a peripheral edge of the bottom, a flange is provided at an upper portion of said sample container holding member, said flange being engaged with said metallic ring so that said metallic ring can receive the centrifugal force acting on said sample container holding member, and said flange is made of said composite material consisting of the reinforcing fiber and the resin and is integrally manufactured with said sample container holding member, and a polyaramide fiber is provided in a surficial layer of said sample container holding member.

3. A swing rotor for a centrifugal separator, comprising:

a rotor body having symmetrically branched arms extending in radial directions at equal angular intervals; and a plurality of buckets swingably supported between respective arms of said rotor body;

wherein each of said plurality of buckets comprises a sample container holding member and a metallic member integrally coupled with each other;

said sample container holding member is made of a composite material consisting of a reinforcing fiber and a resin;

said metallic member has a surface fitting to a surface of said sample container holding member and has portions engaged with said rotor body;

a supporting mechanism is provided for receiving a centrifugal force acting on said sample container holding member by said metallic member; and said supporting mechanism is a flange formed along an opened top of said sample container holding member.

4. The swing rotor for a centrifugal separator in accordance with claim 3, wherein a rib extends along said flange so as to enhance the rigidity of said flange.

5. A swing rotor for a centrifugal separator, comprising:

a rotor body having symmetrically branched arms extending in radial directions at equal angular intervals; and a plurality of buckets swingably supported between respective arms of said rotor body;

wherein each of said plurality of buckets comprises a sample container holding member and a metallic member integrally coupled with each other;

said sample container holding member is made of a composite material consisting of a reinforcing fiber and a resin;

said metallic member has a surface fitting to a surface of said sample container holding member and has portions engaged with said rotor body;

a supporting mechanism is provided for receiving a centrifugal force acting on said sample container holding member by said metallic member;

said metallic member surrounds an upper part of said sample container holding member; and said sample container holding member has a surface perpendicular to an axis of said sample container holding member, said axis of said sample container holding member being identical with a direction of a centrifugal force acting on said sample container holding member, and said metallic member has a surface brought into contact with said surface of said sample container holding member so as to constitute said supporting mechanism.

* * * * *